US009571921B2

(12) United States Patent
Miller

(10) Patent No.: US 9,571,921 B2
(45) Date of Patent: Feb. 14, 2017

(54) RECEIVER ACOUSTIC LOW PASS FILTER

(75) Inventor: Thomas E. Miller, Arlington Heights, IL (US)

(73) Assignee: Knowles Electronics, LLC, Itasca, IL (US)

( * ) Notice: Subject to any disclaimer, the term of this patent is extended or adjusted under 35 U.S.C. 154(b) by 202 days.

(21) Appl. No.: 13/589,538

(22) Filed: Aug. 20, 2012

(65) Prior Publication Data

US 2013/0051580 A1 Feb. 28, 2013

Related U.S. Application Data

(60) Provisional application No. 61/525,914, filed on Aug. 22, 2011.

(51) Int. Cl.
*H04R 1/28* (2006.01)
*H04R 1/10* (2006.01)
*H04R 1/24* (2006.01)

(52) U.S. Cl.
CPC ..... *H04R 1/2857* (2013.01); *H04R 1/1075* (2013.01); *H04R 1/24* (2013.01)

(58) Field of Classification Search
CPC ... H04R 1/2803; H04R 1/2811; H04R 1/2857; H04R 1/2873; H04R 1/10; H04R 1/1016; H04R 1/24; H04R 1/1075; H04R 1/2869; H04R 1/2853; H04R 1/345; H04R 1/2807; H04R 1/28
USPC ..... 381/337, 338, 345, 350, 351, 352, 353,381/182, 370, 372, 380, 382, 186; 181/144, 181/145, 146, 160, 182, 185, 196
See application file for complete search history.

(56) References Cited

U.S. PATENT DOCUMENTS 4,763,753 A 8/1988 Killion
4,942,939 A * 7/1990 Harrison ..... 181/156
5,261,006 A * 11/1993 Nieuwendijk et al. ..... 381/353
5,579,398 A 11/1996 Ewens
5,960,093 A 9/1999 Miller
(Continued)

FOREIGN PATENT DOCUMENTS

CN 101015000 8/2007
CN 101933341 12/2010
(Continued)

OTHER PUBLICATIONS

International Search Report and Written Opinion for related PCT Application No. PCT/US2012/051682, Feb. 27, 2013, 10 pages.
(Continued)

*Primary Examiner* — Vivian Chin
*Assistant Examiner* — Jason R Kurr
(74) *Attorney, Agent, or Firm* — Faegre Baker Daniels LLP

(57) ABSTRACT

A receiver apparatus includes a first receiver portion and an acoustic filter network. The first receiver portion has a housing and is configured to convert at least one electrical signal into first sound energy having a first frequency range. The acoustic filter network communicates with the first receiver portion and is configured to receive the first sound energy. The acoustic filter network includes at least one sound channel and at least one chamber that communicates with the at least one sound channel. The least one sound channel includes a main branch and a first side branch and the at least one chamber comprises a first chamber. The first side branch communicates with the main branch and the first chamber, and the main branch is configured to receive the first sound energy.

20 Claims, 5 Drawing Sheets

(56) References Cited

U.S. PATENT DOCUMENTS

| | | | | |
|---|---|---|---|---|
| 6,751,326 | B2 | 6/2004 | Nepomuceno | |
| 7,123,736 | B2 * | 10/2006 | Eaton | 381/351 |
| 7,477,756 | B2 | 1/2009 | Wickstrom | |
| 7,584,820 | B2 * | 9/2009 | Parker | H04R 1/2857 181/148 |
| 7,680,292 | B2 | 3/2010 | Warren | |
| 7,747,032 | B2 | 6/2010 | Zei | |
| 7,869,610 | B2 | 1/2011 | Jayanth | |
| 8,098,854 | B2 * | 1/2012 | Van Halteren | H04R 1/24 381/182 |
| 8,135,163 | B2 | 3/2012 | Blanchard et al. | |
| 8,194,904 | B2 * | 6/2012 | Iwayama | 381/342 |
| 8,351,629 | B2 * | 1/2013 | Parker et al. | 381/338 |
| 8,401,215 | B2 | 3/2013 | Warren | |
| 8,971,545 | B2 * | 3/2015 | Epping | H04R 1/1016 381/312 |
| 2005/0094836 | A1 * | 5/2005 | Manrique | 381/342 |
| 2005/0117767 | A1 * | 6/2005 | Ito et al. | 381/333 |
| 2005/0276433 | A1 | 12/2005 | Miller | |
| 2006/0227990 | A1 | 10/2006 | Kirchhoefer | |
| 2007/0104340 | A1 | 5/2007 | Miller | |
| 2007/0165892 | A1 | 7/2007 | Aarts | |
| 2007/0201717 | A1 * | 8/2007 | Dyer | H04R 1/1016 381/380 |
| 2007/0223735 | A1 | 9/2007 | Lopresti et al. | |
| 2008/0101640 | A1 | 5/2008 | Ballad | |
| 2009/0046876 | A1 | 2/2009 | Reck | |
| 2009/0214068 | A1 | 8/2009 | Wickstrom | |
| 2013/0272564 | A1 | 10/2013 | Miller | |

FOREIGN PATENT DOCUMENTS

| | | |
|---|---|---|
| JP | 2005109880 | 4/2005 |
| JP | 2008504566 | 2/2008 |

OTHER PUBLICATIONS

International Preliminary Report on Patentability for PCT/US2012/051682, dated Mar. 6, 2014, 7 pages.

Search Report for Chinese Application No. 201280040716.3 dated May 27, 201 6 (9 pages).

* cited by examiner

RECEIVER ACOUSTIC LOW PASS FILTER

CROSS REFERENCE TO RELATED APPLICATION

This patent claims benefit under 35 U.S.C. §119 (e) to U.S. Provisional Application No. 61/525,914 entitled "Receiver Acoustic Low Pass Filter" filed Aug. 22, 2011, the content of which is incorporated herein by reference in its entirety.

TECHNICAL FIELD

This disclosure relates to acoustic devices and, more specifically, to their construction and output characteristics.

BACKGROUND

Various types of microphones and receivers have been used through the years. In these devices, different electrical components are housed together within a housing or assembly. For example, a receiver typically includes a coil, bobbin, stack, among other components and these components are housed within the receiver housing. Other types of acoustic devices may include other types of components. A twin receiver design can be used, one receiver providing for the outputs in the "tweeter" sound range and the other for providing outputs in the "woofer" sound range.

Various two-way receivers are used in earphones and these utilize a single capacitor to shape the high frequency driver (i.e., tweeter) response and no filtering on the low frequency driver (i.e., woofer) response. Sometimes, the natural low-pass shape of the woofer is effective to keep it from overlapping the response of the tweeter receiver. However, this performance limits the cross-over frequency to be a high frequency, which is typically between 2 and 3 kHz. This produces undesirable results in many systems.

Previous attempts at solving this problem have changed the mass and/or stiffness of the motor/diaphragm of the receivers. However, adding mass to the system can have undesirable side effects. For instance, the high mass may cause an uneven acoustic response and make the unit easily damaged when dropped. The uneven response leads to poor sound quality for the listener.

An electric low pass filter can also be added to the system. Inductors can be used to create the low pass filter. However, one problem of this attempted solution is that if inductors are used, they must be large—in some cases larger than the receiver itself. Since the inductors are so large, the resulting device is too large or cumbersome for practical use in many applications. An acoustic low pass filter can be created by adding a long thin tube to the output of the receiver, or by using one or more very small openings in the receiver outlet. Such a filter will reduce the high frequencies, but will still have an undesirable resonance in the 3-5 kHz region. The volume of air trapped between the diaphragm and the receiver outlet forms a compliance, which interacts with the mass of the moving parts in the receiver to form a resonance.

Because of these shortcomings, previous approaches have not adequately addressed the above-mentioned problems and user dissatisfaction with these previous approaches has increased.

BRIEF DESCRIPTION OF THE DRAWINGS

For a more complete understanding of the disclosure, reference should be made to the following detailed description and accompanying drawings wherein.

Figure 1:
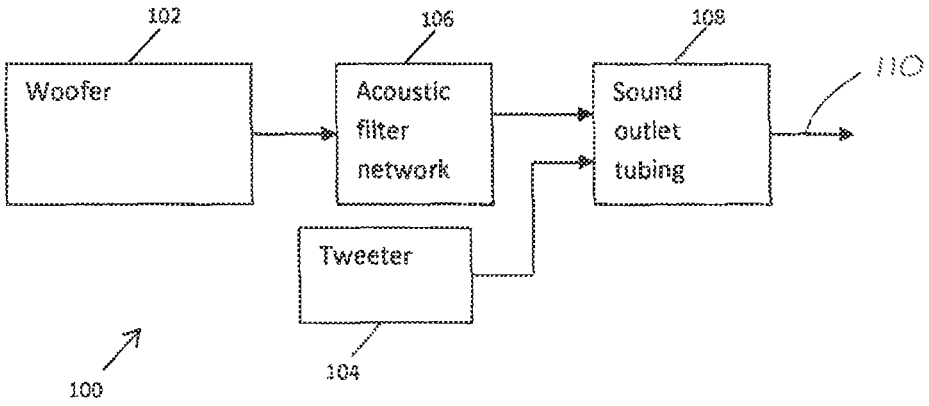
FIG. 1 is a block diagram of a two-way receiver.

Those of ordinary skill in the art will appreciate that elements in the figures are illustrated for simplicity and clarity. It will be appreciated further that certain actions and/or steps may be described or depicted in a particular order of occurrence while those skilled in the art will understand that such specificity with respect to sequence is not actually required. It will also be understood that the terms and expressions used herein have the ordinary meaning as is accorded to such terms and expressions with respect to their corresponding respective areas of inquiry and study except where specific meanings have otherwise been set forth herein.

DETAILED DESCRIPTION

Receivers are provided that are coupled to, incorporate, or utilize low pass acoustic filters and substantially reduce resonant peaks produced or associated with these receivers. More specifically, resonance problems present at the output of the receiver (caused, for example, by resonance produced by portions of the receiver) are reduced or substantially eliminated. The approaches provided herein are easy to implement, are implemented with structures that are small in size, and significantly reduce or eliminate the above-mentioned resonance concerns, thereby providing the listener with an improved listening experience.

In many of these embodiments, a receiver apparatus includes a first receiver portion and an acoustic filter network. The first receiver portion has a housing and is configured to convert at least one electrical signal into first sound energy having a first frequency range. The acoustic filter network communicates with the first receiver portion and is configured to receive the first sound energy. The acoustic filter network includes at least one sound channel and at least one chamber that communicates with the at least one sound channel. In some aspects, the at least one sound channel includes a main branch and a first side branch and the at least one chamber comprises a first chamber. The first side branch communicates with the main branch and the first chamber, and the main branch is configured to receive the first sound energy.

In some aspects, the at least one sound channel includes at least one tube. In other aspects, the at least one sound channel comprises at least one groove disposed in at least one plate. In some examples, the at least one plate is disposed on a surface (e.g., a top surface) of the receiver housing. In other aspects, the at least one sound channel comprises at least one pipe. In some examples, the at least one pipe is disposed on a surface (e.g., a top surface) of the receiver housing.

In additional aspects, the at least one channel further includes a second side branch and the at least one chamber further comprises a second chamber. The second branch communicates with the main branch and the second chamber.

In other examples, the receiver apparatus further includes a sound outlet channel that communicates with the acoustic filter network and is configured to receive the filtered first sound energy from the acoustic filter network. In one aspect, the sound outlet channel is a sound outlet tube.

In others of these embodiments, the receiver apparatus includes a second receiver portion that communicates with the sound outlet channel. The second receiver portion receives the electrical signal and converts the at least one electrical signal into second sound energy having a second frequency range. In some aspects, the first receiver portion is a woofer and the second receiver is a tweeter.

In one specific example of the approaches described herein, an acoustic notch filter is used to cancel out the front volume resonance of a receiver, for example, the front volume resonance of a woofer receiver. A side branch is added to a main branch tubing at the output of the woofer receiver. The side branch tubing in one aspect has a resonance that matches the resonance that is to be canceled. In one approach, the side branch tube coupled to the main branch tube terminates in a small volume or chamber. In one example woofer receiver, a 10 mm tube of 20 gauge connected to a 1.4 $mm^3$ cavity (chamber) is used. This sized chamber can be constructed by adding a 3×3×0.16 mm (0.118×0.118×0.006 inches) hollow box on top of the receiver. It will be appreciated that these dimensions are examples only and that other dimensions can be used.

Referring now to FIG. 1, one example of a receiver apparatus 100 with a low pass acoustic filter is described. The apparatus 100 includes a woofer portion 102 and a tweeter portion 104 (e.g., a tweeter). The portions 102 and 104 receive electrical signals and convert the electrical signals into sound energy in their respective frequency ranges (low frequency ranges for the woofer and high frequency ranges for the tweeter). As will be described in greater detail herein, the sound output of the woofer portion 102 is modified/damped by an acoustic filter network 106. The output of the network 106 and the second portion (the tweeter) 104 pass through common sound outlet tubing 108 to an output 110. As will be described in greater detail herein the network 106 may include tubing and a chamber that act to dampen the resonance frequency caused by portions of the woofer 102.

The receiver portions 102 and 104 may include elements such as a diaphragms, magnets, coils, bobbins, back volumes and so forth, which are typically used in receivers. As mentioned, one of the receivers 102 may produce sounds that are in the woofer range while the other receiver 104 may produce sounds in the tweeter range. This arrangement is known as a "two-way" receiver. It will also be appreciated that three-way receivers are also possible and that the approaches described herein can be applied to these devices as well. The filter network 106 is described in greater detail in the description below.

Figure 2A:
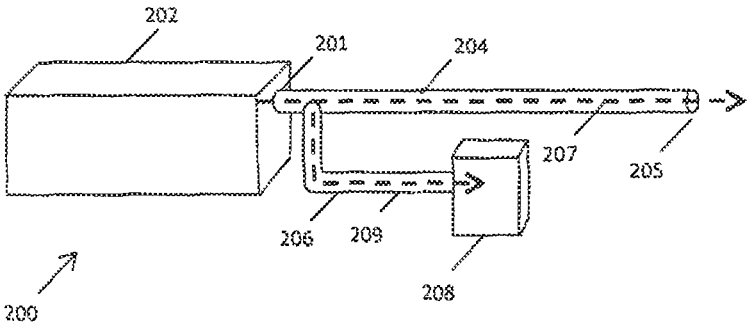
FIGS. 2A and 2B are perspective drawings showing receivers with acoustic low pass filters.

Referring now to FIG. 2A, one example of an apparatus 200 including an acoustic low pass filter is described. A receiver 202 (e.g., woofer receiver 102 of FIG. 1) has coupled to it a main branch tube 204. Coupled to the main branch tube 204 is a side branch tube 206 and coupled to the side branch tube 206 is a resonant chamber 208. The receiver 202 has an output 201 through which sound is output and enters the main branch tube 204. Within the receiver housing is a front volume, back volume, diaphragm, and other components that will not be described in greater detail here. In one example, the receiver is a TEC-30033-000 manufactured by Knowles Electronics, LLC. The receiver 202 receives electrical energy representing sound and outputs sound from the output 201. Together, the main branch tube 204, the side branch tube 206, and the chamber 208 form an acoustic low pass filter (the main branch 204 is a low pass filter, and side branch and chamber as described herein form a notch filter). One effect of the notch filter is to reduce the energy transmitted by the filter over a band of frequencies. For example, the filter may reduce the amplitude of frequencies between 2 and 3 kHz by 5 to 10 dB.

The main branch tube 204 and the side branch tube 206 in one example are hollow hypodermic tubes (e.g., 1 mm in diameter, 20 gauge). The chamber 208 is a hollow chamber constructed from a stiff material and in one example is 1.5 cubic mm. The stiff material may be a metal (e.g., brass, stainless steel) that has good sound reflection properties such that sound is not absorbed or is minimally absorbed. It will be appreciated that other construction materials can be used to construct these components and that other dimensions may also be used.

As shown in FIG. 2A, sound enters the main branch tube 204 and flows through this tube to exit the tube at opening 205 in the direction indicated by the arrow labeled 207. Sound also enters the side branch tube 206 and flows into the chamber 208 in the direction generally indicated by the arrow labeled 209.

Figure 3A:
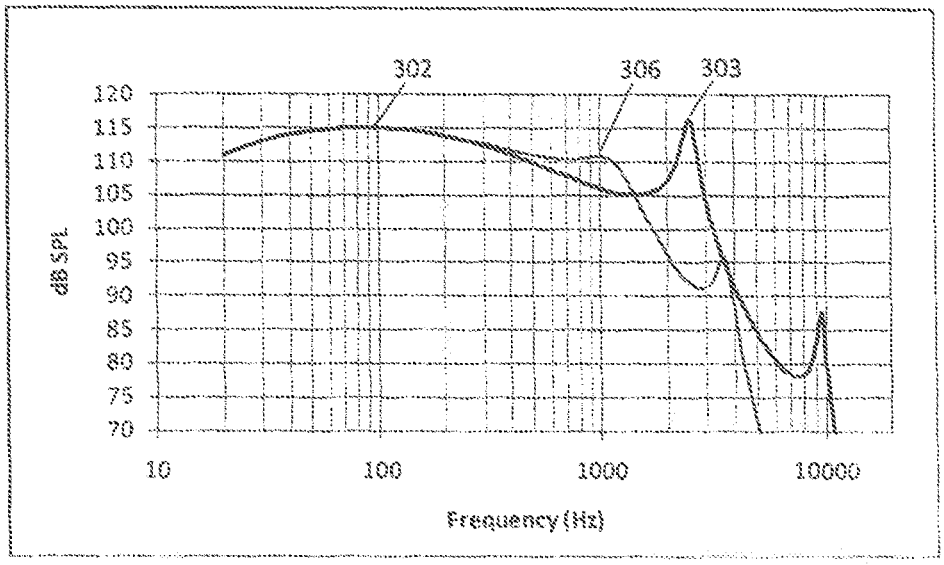
FIGS. 3A and 3B are graphs showing that the resonant frequency is reduced or eliminated using the approaches.
Figure 3B:
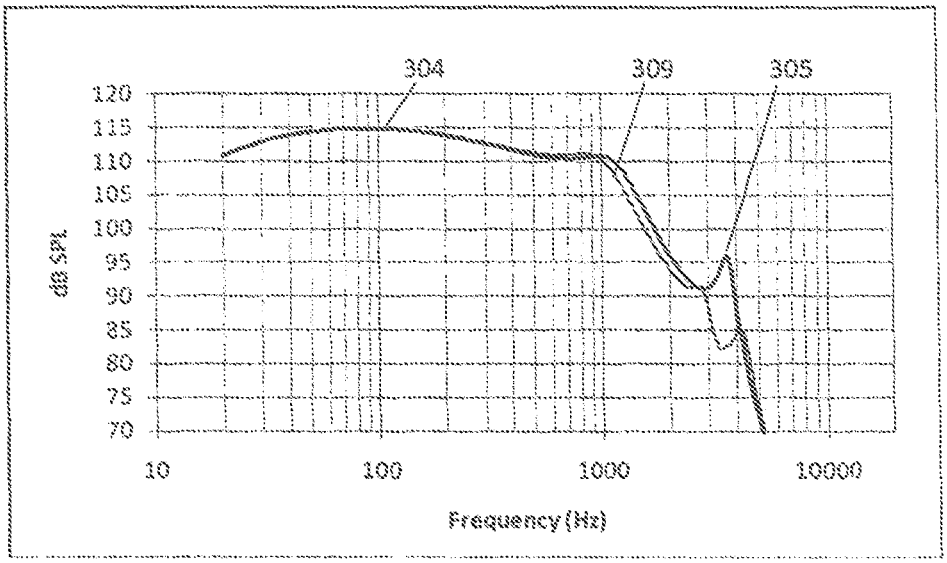

Referring now to FIGS. 3A and 3B, graphs showing the effects of using the low pass acoustic filter is described with a receiver such as that shown in FIG. 2A is described. It can be seen that in both of these graphs response (shown in dB units) is plotted against frequency. First curves 302 and 304 show the response of the receiver without the use of the filter. It can be seen that each has a resonant peak 303 and 305 respectively that adversely affects the operation of the receiver. Adding a long thin tube changes curve 302 to curve 306 in FIG. 3A (which is the same as 304 in FIG. 3B). This has the effect of reducing most of the high frequencies, and can be referred to as a low pass filter. Adding the side branch changes curve 304 to 309, removing the small peak at 3.5 kHz. The side branch and chamber as described herein form a notch filter. With the filter (e.g., the side branch 206 and the chamber 208 in FIG. 2A) added, it can be seen that the filter significantly reduces or eliminates the output peaks thereby improving the performance of the receiver and the listening experience of the user. These separate graphs show illustrative curves and specific values for two examples of receivers. It will be appreciated that the approaches described herein can create responsive curves having other values/shapes depending upon the factors described elsewhere herein.

Without the filter, air resonates with the mechanical parts of the receiver to create an output peak, for example, the peak 305 in FIG. 3B. In operation, sound and air is reflected out of the chamber and the dimensions of the chamber, e.g., the chamber 208 in FIG. 2A, are chosen so that the output peak 305 is controlled. With the proper combination of frequency and Q, the notch filter can be tuned to create a complementary filter, cancelling the acoustic resonance and providing a smooth response. The dimensions of chamber 208 and the length of tube 204 control the frequency and the Q of the notch filter. A larger chamber, a longer tube, or a smaller diameter tube all reduce the frequency of the filter. A smaller diameter tube increases viscous losses, reducing the Q of the filter. A narrower tube produces a smaller reduction of the peak. A larger tube produces a greater reduction of the peak.

Figure 2B:
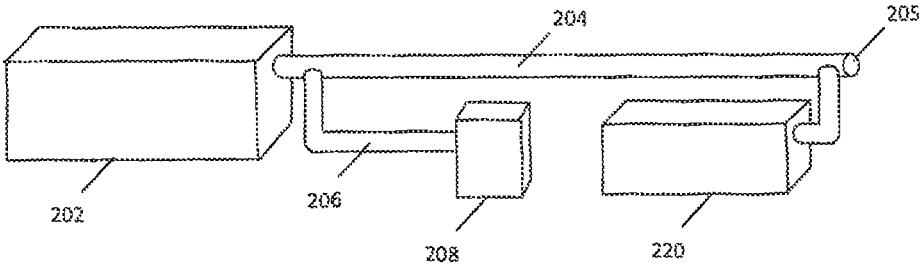

Referring now to FIG. 2B, an example of a system is shown that includes a tweeter receiver. The same elements of FIG. 2B have the same numbers as those shown in FIG. 2A and their descriptions will not be repeated again here. As shown in FIG. 2B, a high frequency tweeter device 220 is coupled to the main branch tube 204 through a short tube and the sounds of both exit at the sound outlet 205. The operation of the apparatus of FIG. 2B is the same as that of the apparatus of FIG. 2A except that the tweeter 220 also adds high frequency sounds that are not damped by the resonant chamber 208 and the side branch 206.

Figure 4A:
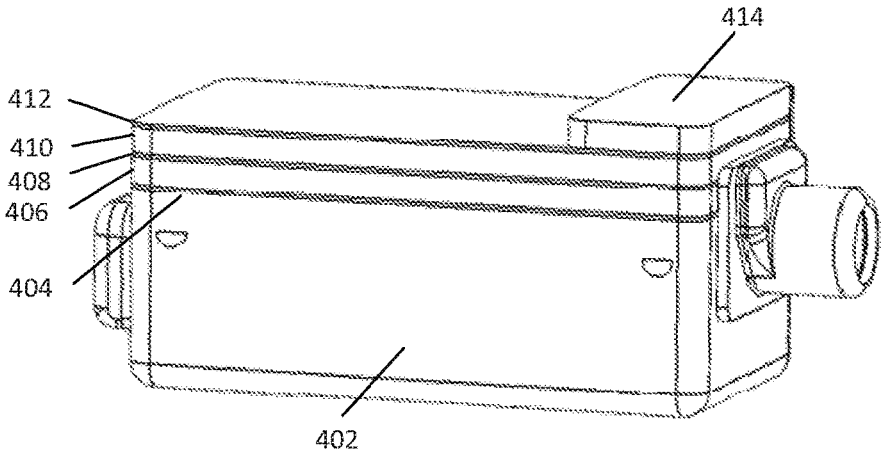
FIGS. 4A and 4B are perspective drawings showing a receiver and an acoustic low pass filter.
Figure 4B:
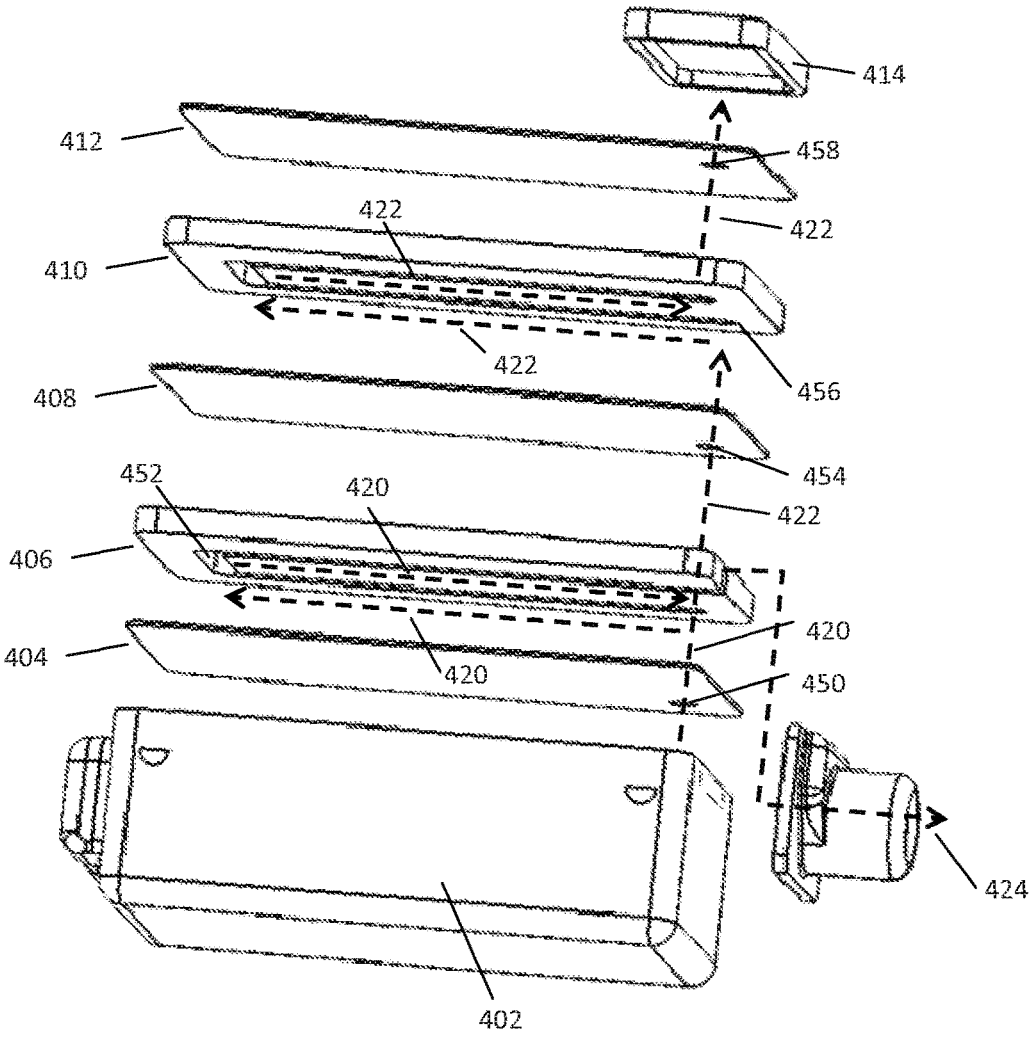

Referring now to FIGS. 4A and 4B, another example of a receiver with an acoustic low pass filter is described. In this example, the tubes of FIGS. 2A and 2B are replaced with grooved plates and these grooves (along with the cover plates) form the "tubes" of FIGS. 2A and 2B. As shown, a receiver 402 is coupled to a first plate 404; the first plate 404 is coupled to a second plate 406; the second plate 406 is coupled to a third plate 408; the third plate 408 is coupled to a fourth plate 410; and the fourth plate 410 is coupled to a fifth plate 412. The second plate 406 and the fourth plate 410 form pipes (notches) that as shown are generally u-shaped. The thickness of the plates 404, 408, and 412 is approximately 0.05 mm (0.002 inches) while the thickness of the plates 406 and 410 is approximately 0.25 mm (0.010 inches). Other dimensions are possible. The chamber 414 is coupled to the fifth plate 412.

A hole 450 in the first plate 404 communicates with a slot 452 in the second plate 406. The slot 452 in the second plate 406 communicates with a hole 454 in the third plate 408; the hole 454 in the third plate 408 communicates with a slot 456 in the fourth plate 410. The slot 456 in the fourth plate 410 communicates with a hole 458 in the fifth plate 412. The hole 458 in the fifth plate 412 communicates with the chamber 414. In one example, the holes 450, 454, and 458 are 0.25 mm (0.010 inches) in diameter. The width of the slots or notches 452 and 456 are 0.25 mm (0.010 inches) in one example. Other dimensions are possible.

In operation, sound travels up through the holes in the first plate 404 and the third plate 408 into the slots in the second plate 406 and the fourth plate 410. The first plate 404, the second plate 406, and the third plate 408 form the pipe of the main branch tube. The third plate 408, the fourth plate 410, and the fifth plate 412 form the side branch tube. As shown, sound enters the main branch tube and travels in the direction indicated by the arrow labeled 420 and the side branch tube in the direction indicated by the arrow 422, and is reflected by the chamber 414 and exits in the direction indicated by the arrow 424.

Figure 5:
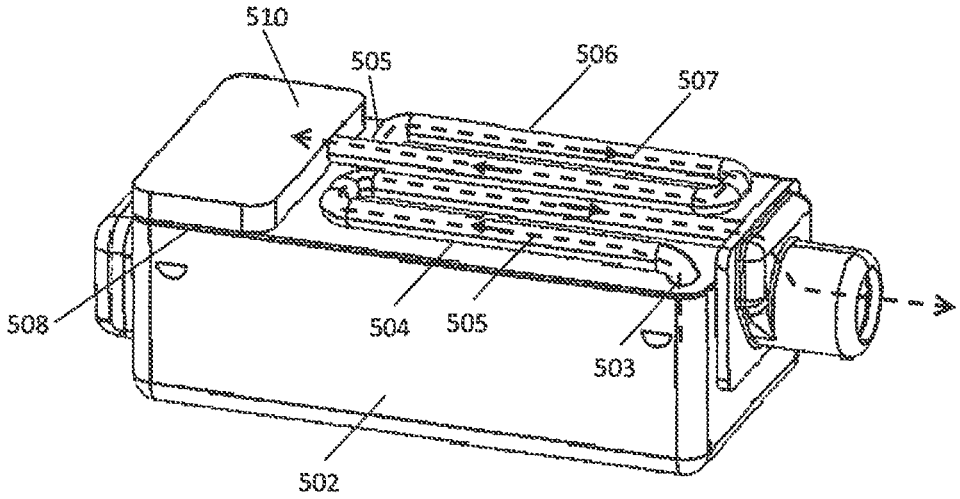
FIG. 5 is a perspective drawing showing a receiver and an acoustic low pass filter.

Referring now to FIG. 5, another version of a receiver with an acoustic low pass filter is described. In contrast to the example of FIGS. 4A and 4B, slotted plates are not used. Instead, a receiver 502 is coupled to a main branch pipe 504 and a side branch pipe 506. A flat cover 508 communicates with the front volume of the receiver 502. For simplicity, the front volume is not shown in the example of FIG. 5. A chamber 510 communicates with the side branch pipe 506. Both the main and side branches originate in the top chamber of the receiver and exit through holes 503 and 505 (respectively) at opposite ends of the flat top cover 508 of the front volume. In other words, there are two holes in the front volume through which air directly enters the side and main branches (i.e., air does not have to go through the main pipe to reach the branch pipe).

In operation air enters the side branch 506 (and flows in the direction indicated by the arrows 507) and the main branch 504 (and flows in the direction indicated by the arrows labeled 505). Reflections from the chamber go back to the front volume of the receiver to dampen the resonant frequency of air exiting through the main branch pipe 504 as has been described elsewhere herein.

Preferred embodiments are described herein, including the best mode known to the inventor(s). It should be understood that the illustrated embodiments are exemplary only, and should not be taken as limiting the scope of the appended claims.

What is claimed is:

1. A receiver apparatus comprising:

a first receiver portion, the first receiver portion having a housing with a single sound outlet and configured to convert at least one electrical signal into first sound energy having a first frequency range;

a second receiver portion, the second receiver portion configured to convert the at least one electrical signal into second sound energy having a second frequency range; and an acoustic filter network, the acoustic filter network communicating with the single sound outlet and configured to receive the first sound energy, the acoustic filter network including a main branch, a first side branch, and a first chamber, the first side branch communicating with the main branch and the first chamber, the main branch having a first end and a second end and being configured to receive the first sound energy, such that all sound energy radiating from the first receiver portion including the first sound energy passes exclusively through the acoustic filter network before any of the first sound energy radiates out to an exterior environment, wherein the first receiver portion is coupled to the first end of the main branch and the second receiver portion is coupled to the main branch between the first side branch and the second end of the main branch.

2. The receiver apparatus of claim 1 wherein the main branch and the first side branch comprise at least one tube.

3. The receiver apparatus of claim 1 wherein the main branch and the first side branch comprise at least one groove disposed in at least one plate.

4. The receiver apparatus of claim 3 wherein the at least one plate is disposed on a surface of the receiver housing.

5. The receiver apparatus of claim 1 wherein the main branch and the first side branch comprise at least one pipe.

6. The receiver apparatus of claim 5 wherein the at least one pipe is disposed on a surface of the receiver housing.

7. The receiver apparatus of claim 1 further comprising a second side branch and a second chamber, the second side branch communicating with the main branch and the second chamber.

8. The receiver apparatus of claim 1 further comprising a sound outlet channel, the sound outlet channel communicating with the acoustic filter network and configured to receive filtered first sound energy from the acoustic filter network.

9. The receiver apparatus of claim 8 wherein the sound outlet channel comprises a sound outlet tube.

10. The receiver apparatus of claim 1 wherein the first receiver portion comprises a woofer and the second receiver portion comprises a tweeter.

11. A receiver having an acoustic output, the receiver comprising:

a first transducer disposed within a first housing, the first transducer having an electrical signal input and an acoustic signal output into a first front volume of the first housing;

a second transducer disposed within a second housing, the second transducer having an electrical signal input and an acoustic signal output into a second front volume of the second housing, the second front volume of the second housing acoustically coupled to the acoustic output of the receiver;

an acoustic low pass filter including an acoustic channel having an input port acoustically coupled to the first front volume of the first housing, the acoustic channel of the acoustic low pass filter having an output port acoustically coupled to the acoustic output of the receiver;

an acoustic notch filter including an acoustic channel having an input port acoustically coupled to the first front volume of the first housing, the acoustic channel of the acoustic notch filter having an output port acoustically coupled to a chamber, all acoustic energy emanating from the first front volume of the first housing filtered by the acoustic low pass filter and the acoustic notch filter, wherein the acoustic low pass filter and the acoustic notch filter dampen resonant frequencies of the receiver.

12. The receiver of claim 11, the first transducer having a relatively low frequency response and the second transducer having a relatively high frequency response, the input port of the acoustic notch filter coupled to the acoustic channel of the acoustic low pass filter, the second front volume of the second housing acoustically coupled to the acoustic channel of the acoustic low pass filter between the acoustic channel of the acoustic notch filter and the output port of the acoustic low pass filter.

13. The receiver of claim 12, the acoustic low pass filter dimensioned to reduce a first resonant frequency peak of the receiver, and the acoustic notch filter dimensioned to reduce a second resonant frequency peak of the receiver.

14. The receiver of claim 11, the first transducer having a relatively low frequency response and the second transducer having a relatively high frequency response, the acoustic notch filter coupled directly to the first front volume by the acoustic channel of the notch filter, and the acoustic low pass filter coupled directly to the first front volume by the acoustic channel of the acoustic low pass filter.

15. The receiver of claim 11, the acoustic low pass filter channel having a dimension that reduces a first resonant frequency peak of the receiver, and the chamber and acoustic channel of the acoustic notch filter having dimensions that reduce a second resonant frequency peak of the receiver.

16. The receiver of claim 11, acoustic energy emanating from the first front volume of the first housing to the acoustic notch filter reflected by the chamber of the acoustic notch filter back toward the first front volume of the first housing.

17. An acoustic receiver having an output, the receiver comprising:

a transducer disposed within a housing, the transducer having an electrical signal input and an acoustic signal output into a front volume of the housing;

an acoustic low pass filter including an acoustic channel having an input port acoustically coupled directly to the front volume of the housing, the acoustic channel of the acoustic low pass filter having an output port acoustically coupled to the receiver output;

an acoustic notch filter including an acoustic channel having an input port acoustically coupled directly to the front volume of the housing, the acoustic channel of the acoustic notch filter having an output port acoustically coupled to a chamber, all acoustic energy emanating from the first front volume of the first housing propagating to the output of the receiver via either the acoustic low pass filter or the acoustic notch filter, wherein the acoustic low pass filter and the acoustic notch filter dampen resonant frequencies of the receiver.

18. The receiver of claim 17, acoustic energy emanating from the front volume of the housing to the acoustic notch filter reflected by the chamber of the acoustic notch filter back toward the front volume of the housing.

19. The receiver of claim 17, the acoustic low pass filter channel having a dimension that reduces a first resonant frequency peak of the receiver, and the chamber and acoustic channel of the acoustic notch filter have dimensions that reduce a second resonant frequency peak of the receiver.

20. The receiver of claim 17 further comprising second transducer disposed within a second housing, the second transducer having an electrical signal input and an acoustic signal output into a second front volume of the second housing, the second front volume of the second housing having an output port acoustically coupled to the receiver output.

* * * * *